US007661566B2

(12) United States Patent
Yoshie et al.

(10) Patent No.: US 7,661,566 B2
(45) Date of Patent: Feb. 16, 2010

(54) INFANT CARRIER WITH HOOD

(75) Inventors: Toshiro Yoshie, Tokyo (JP); Yutaka Ukitsu, Tokyo (JP)

(73) Assignee: Combi Corporation, Tokyo (JP)

( * ) Notice: Subject to any disclaimer, the term of this patent is extended or adjusted under 35 U.S.C. 154(b) by 777 days.

(21) Appl. No.: 11/209,641

(22) Filed: Aug. 24, 2005

(65) Prior Publication Data

US 2006/0113337 A1 Jun. 1, 2006

(30) Foreign Application Priority Data

Aug. 26, 2004 (JP) ..... 2004-247060

(51) Int. Cl.
*A61G 1/00* (2006.01)

(52) U.S. Cl. ..... 224/159; 224/158; 224/581

(58) Field of Classification Search ..... 224/159, 224/158, 581, 625
See application file for complete search history.

(56) References Cited

U.S. PATENT DOCUMENTS 3,481,517 A * 12/1969 Aukerman ..... 224/160
5,195,666 A * 3/1993 Yamaguchi et al. ..... 224/159
5,246,152 A * 9/1993 Dotseth ..... 224/159
5,292,042 A * 3/1994 Yamaguchi et al. ..... 224/159
5,439,153 A * 8/1995 Murdoch et al. ..... 224/658
5,492,256 A * 2/1996 Ive ..... 224/159
5,609,279 A * 3/1997 O'Shea ..... 224/160
5,641,101 A * 6/1997 Nakayama ..... 224/159
5,657,912 A * 8/1997 Nakayama ..... 224/159
5,711,466 A * 1/1998 Kataoka et al. ..... 224/159
5,848,741 A * 12/1998 Fair ..... 224/160
5,934,528 A * 8/1999 Higuchi ..... 224/159
6,325,259 B1 * 12/2001 Tharalson et al. ..... 224/161
6,598,771 B2 * 7/2003 Norman ..... 224/160
7,287,676 B2 * 10/2007 Chua ..... 224/160
2003/0178452 A1 * 9/2003 Norman ..... 224/160
2007/0175934 A1 * 8/2007 Boal et al. ..... 224/159

FOREIGN PATENT DOCUMENTS

FR 2 806 279 9/2001
JP 09-094136 4/1997
JP 2000-262360 9/2000

* cited by examiner

*Primary Examiner*—Nathan J Newhouse
*Assistant Examiner*—John Cogill
(74) *Attorney, Agent, or Firm*—Young & Thompson

(57) ABSTRACT

An infant carrier with hood comprises a belt portion to be mounted on a user, and a support portion connected to the belt portion for supporting an infant. A bag-like accommodating portion is provided on an outside face of the support portion and a hood capable of being developed so as to cover the infant supported by the support portion is accommodated in the accommodating portion.

6 Claims, 14 Drawing Sheets

INFANT CARRIER WITH HOOD

BACKGROUND OF THE INVENTION

The present invention relates to an infant carrier with hood for covering an infant.

There has been well known an infant carrier to be used to hold an infant easily when a user moves while holding the infant.

However, because a conventional infant carrier cannot cover an infant sufficiently although it is highly usable when a user moves while holding the infant, it is difficult either to protect the infant's body from wind and rain or to adjust his or her body temperature. A cold protection gear, a rain protection gear and the like that can cover the infant's body from above the infant carrier has been marketed. However, it is inconvenient to carry such a gear separately in addition to the infant carrier.

SUMMARY OF THE INVENTION

Accordingly, an object of the present invention is to provide an infant carrier capable of protecting an infant from wind and rain and securing convenience for a user. In this specification, the word of "infant" is used as a concept including a baby.

To achieve the above-described object, as one aspect of the present invention, there is provided an infant carrier with hood comprising: a belt portion to be mounted on a user; and a support portion connected to the belt portion for supporting an infant, wherein a bag-like accommodating portion is provided on an outside face of the support portion and a hood capable of being developed so as to cover the infant supported by the support portion is accommodated in the accommodating portion.

According to the infant carrier described above, by pulling out the hood from the accommodating portion and by covering an infant supported by the support portion with that hood, the infant can be protected from wind, rain and other weather. By using or not using the hood corresponding to the weather, the body temperature of the infant can be adjusted. Because the hood can be accommodated in the accommodating portion when it is not used, the hood is not a hindrance when the infant carrier is used and convenient for carrying.

According to one embodiment of the present invention, the hood may comprise a head protecting portion for covering the head of the infant and a hip protecting portion for covering the hip of the infant and may be connected to the support portion at an intermediate portion sandwiched between the head protecting portion and the hip protecting portion. According to such embodiment, with the intermediate portion of the hood captured securely by the support portion, the hood can be developed up and down with respect to that capturing position so as to cover the head and the hip of the infant. When accommodating the hood, the head protecting portion and the hip protecting portion only have to be folded toward the central portion. As a consequence, development and accommodation of the hood can be carried out easily.

In one embodiment of the present invention, the infant carrier with hood may further comprise joint means for jointing both side portions of the hood and the belt portion with each other. According to such embodiment, by connecting the hood and the belt portion with the joint means, both sides of the hood can be prevented from being turned up so as to cover the infant body with the hood securely.

According to one embodiment of the present invention, an inside of the accommodating portion may be partitioned into two or more accommodating chambers and the hood may be accommodated in any one of the accommodating chambers. According to this embodiment, one accommodating chamber for accommodating the hood and the other accommodating chamber for accommodating other article than the hood can be distinguished from each other and therefore, its usability is intensified for the user.

According to one embodiment of the present invention, the support portion may comprise an upper sheet and a lower sheet, bag main bodies may be joined to the upper sheet so as to form first and second accommodating bags which can be opened and closed using the upper sheet as a lid material, the second accommodating bag may serve as the accommodating portion, the lower sheet can be accommodated in the first accommodating bag while the hood can be accommodated in the second accommodating bag, and thus the infant carrier can be reformed just like a shoulder bag. Further, the belt portion may comprise a shoulder belt portion joined to the upper sheet of the support portion and the waist belt portion joined to the lower sheet thereof.

DETAILED DESCRIPTION OF THE PREFERRED EMBODIMENTS

Figure 1:
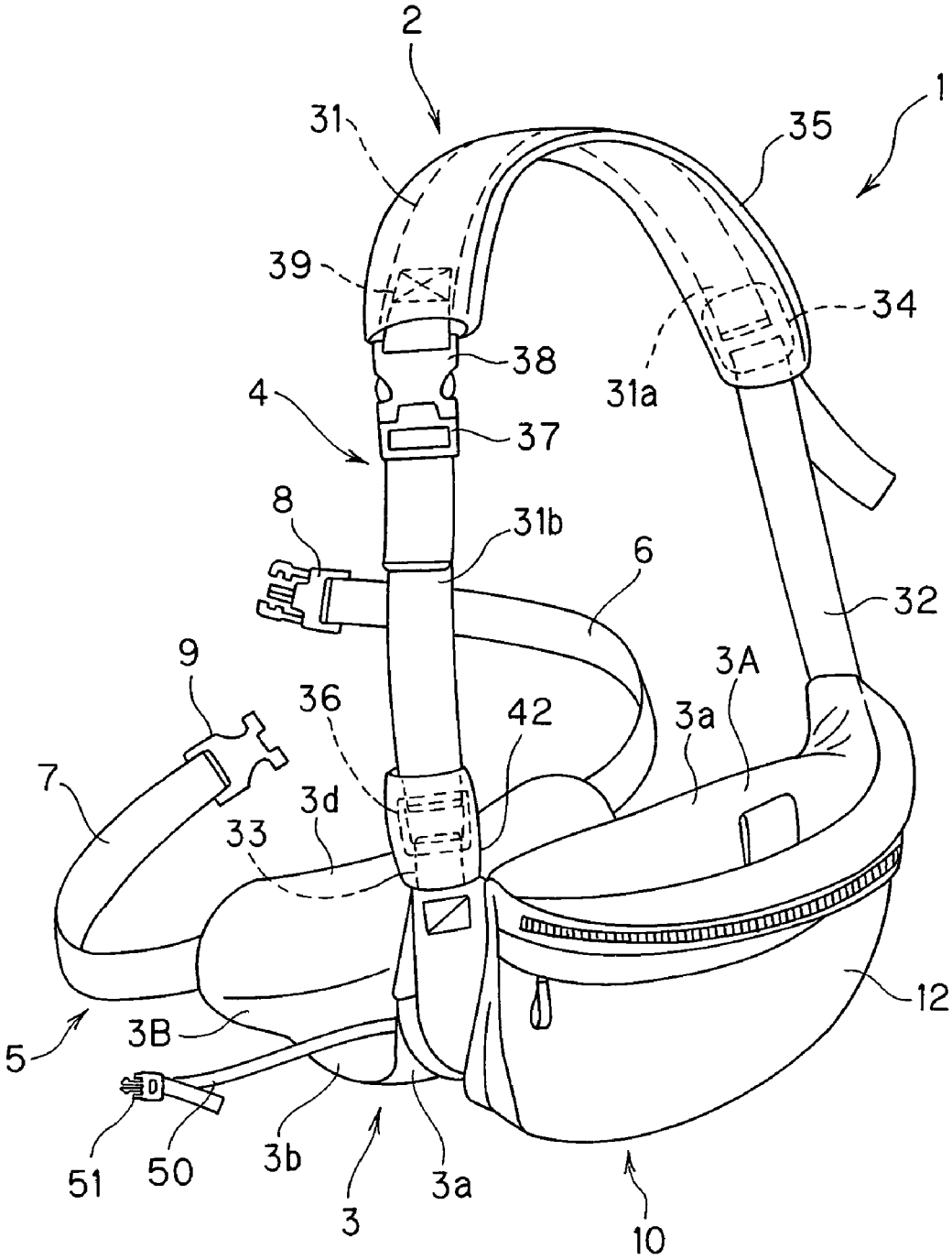
FIG. 1 is a perspective view of an infant carrier according to one embodiment of the present invention.
Figure 2:
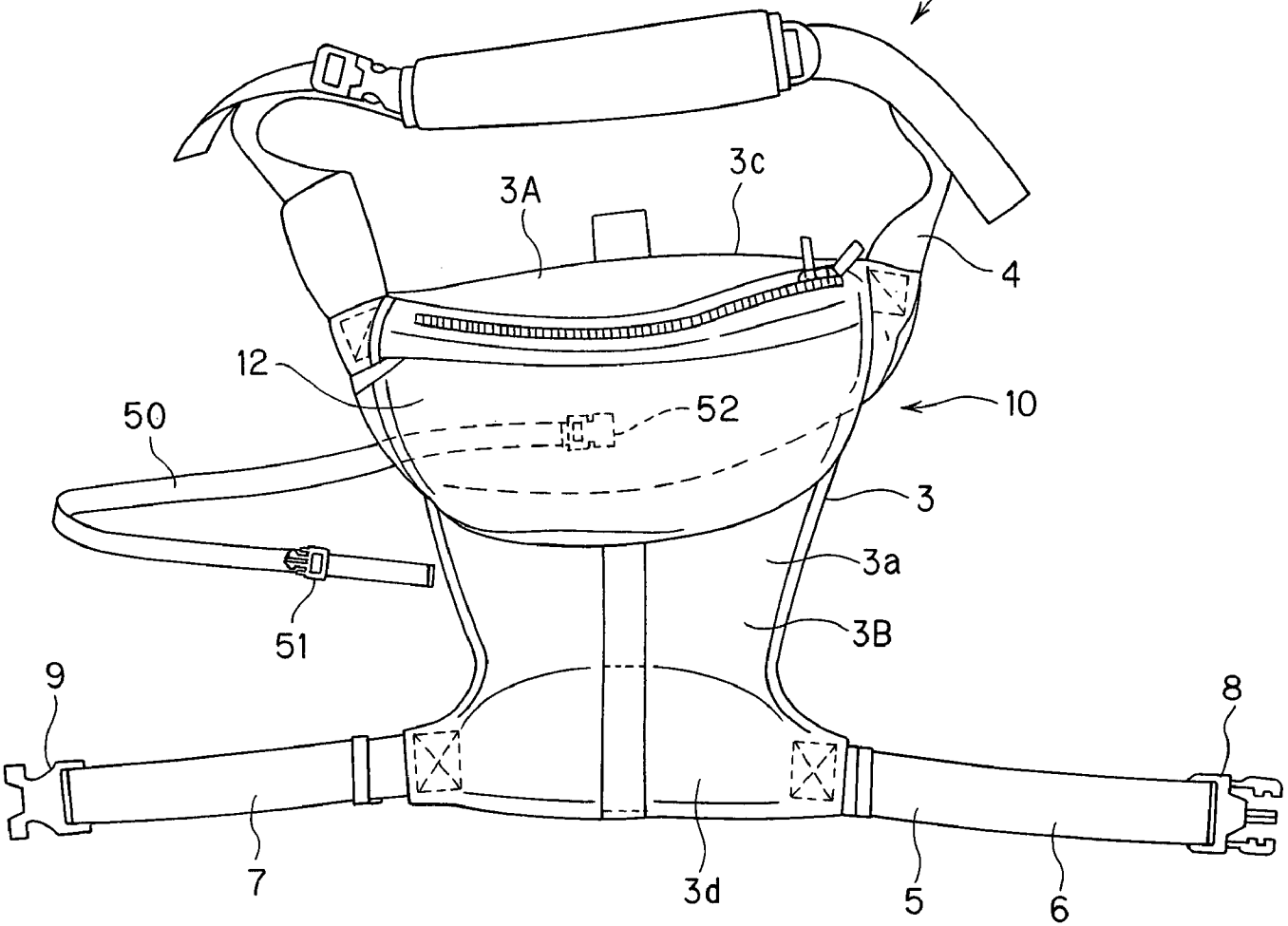
FIG. 2 is a view showing an outside face of a developed infant carrier.
Figure 3:
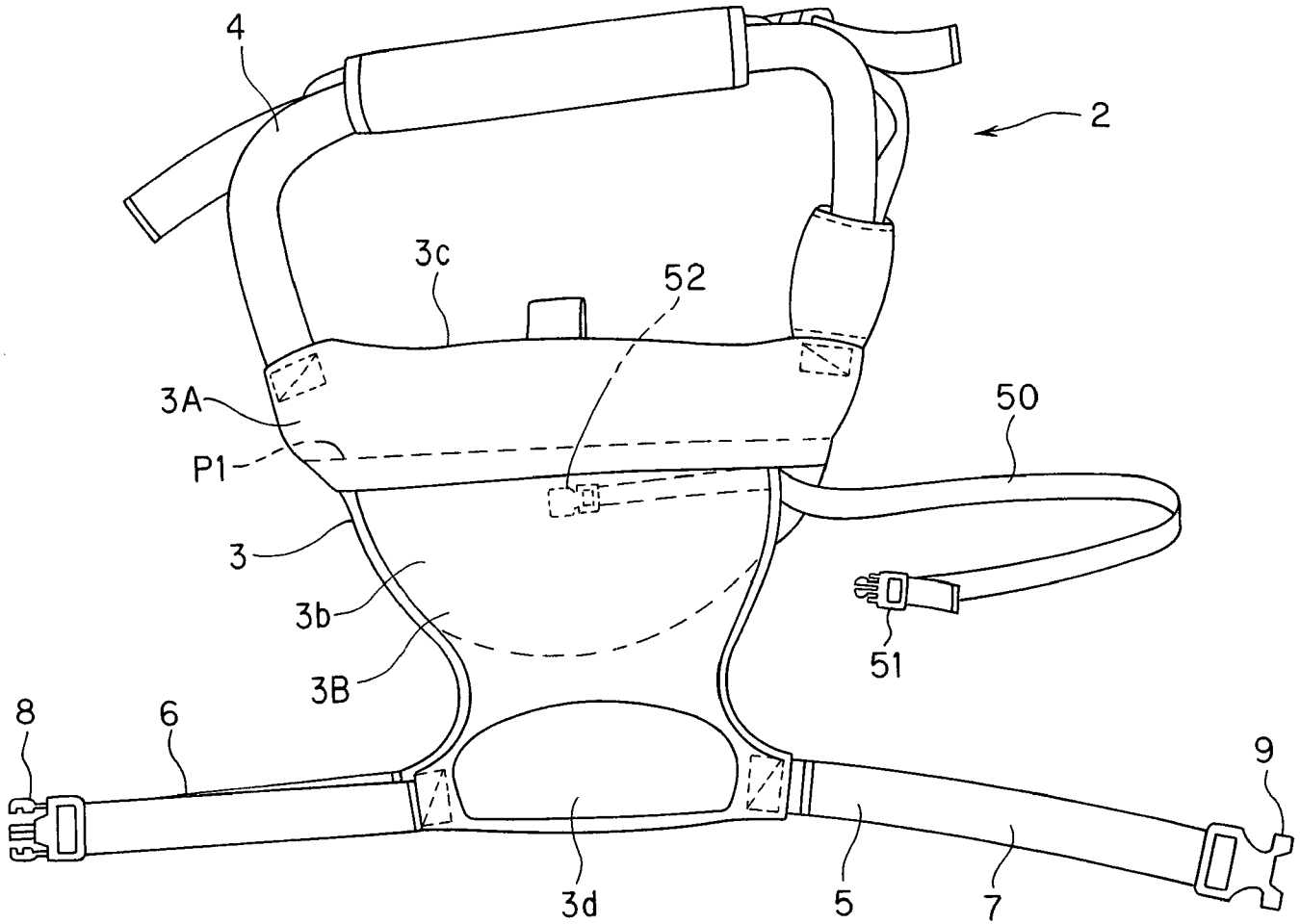
FIG. 3 is a view showing an inside face of the developed infant carrier.

FIG. 1 shows an infant carrier according to one embodiment of the present invention. The infant carrier 1 comprises a belt portion 2 and a support portion 3 which is connected to the belt portion 2 for forming a bag shaped or belt shaped portion for supporting an infant. FIG. 2 shows the a developed infant carrier 1 as seen from an outside face 3*a* of the support portion 3 and FIG. 3 shows the infant carrier 1 in the same condition as FIG. 2 as seen from the inside face 3*b* of the support portion 3. Hereinafter, the top and bottom, and the right and left of the infant carrier 1 are determined with the condition of FIG. 3 as a criterion.

As shown in FIGS. 1 to 3, the support portion 3 is generally configured by sewing an upper sheet 3A and a lower sheet 3B with each other along a sewing line P1 (FIG. 3) and entirely has a single sheet shape having a size suitable for supporting an infant. The belt portion 2 is used for mounting the support portion 3 on a user body and comprises a shoulder belt portion 4 which is connected to a top end portion 3*c* of the upper sheet 3A of the support portion 3 and a waist belt portion 5 which is connected to a bottom end portion 3*d* of the lower sheet 3B of the support portion 3. The shoulder belt portion 4 is mounted on the shoulder of a user (for example, parent) and the waist belt portion 5 is mounted around the waist of the user. Both ends of the shoulder belt portion 4 are sewed with right and left ends of the top end portion 3*c* of the support portion 3 so as to form a closed loop. The shoulder belt portion 4 is adjustable in its length and its detail will be described later. On the other hand, the waist belt portion 5 comprises a pair of joint belts 6 and 7 each sewed to right or left end of the bottom end portion 3*d* of the support portion 3 and a male buckle 8 and a female buckle 9 attached to these belts 6 and 7. The mounting positions of the buckles 8 and 9 can be adjusted in the length direction of the belts 6 and 7.

Figure 4:
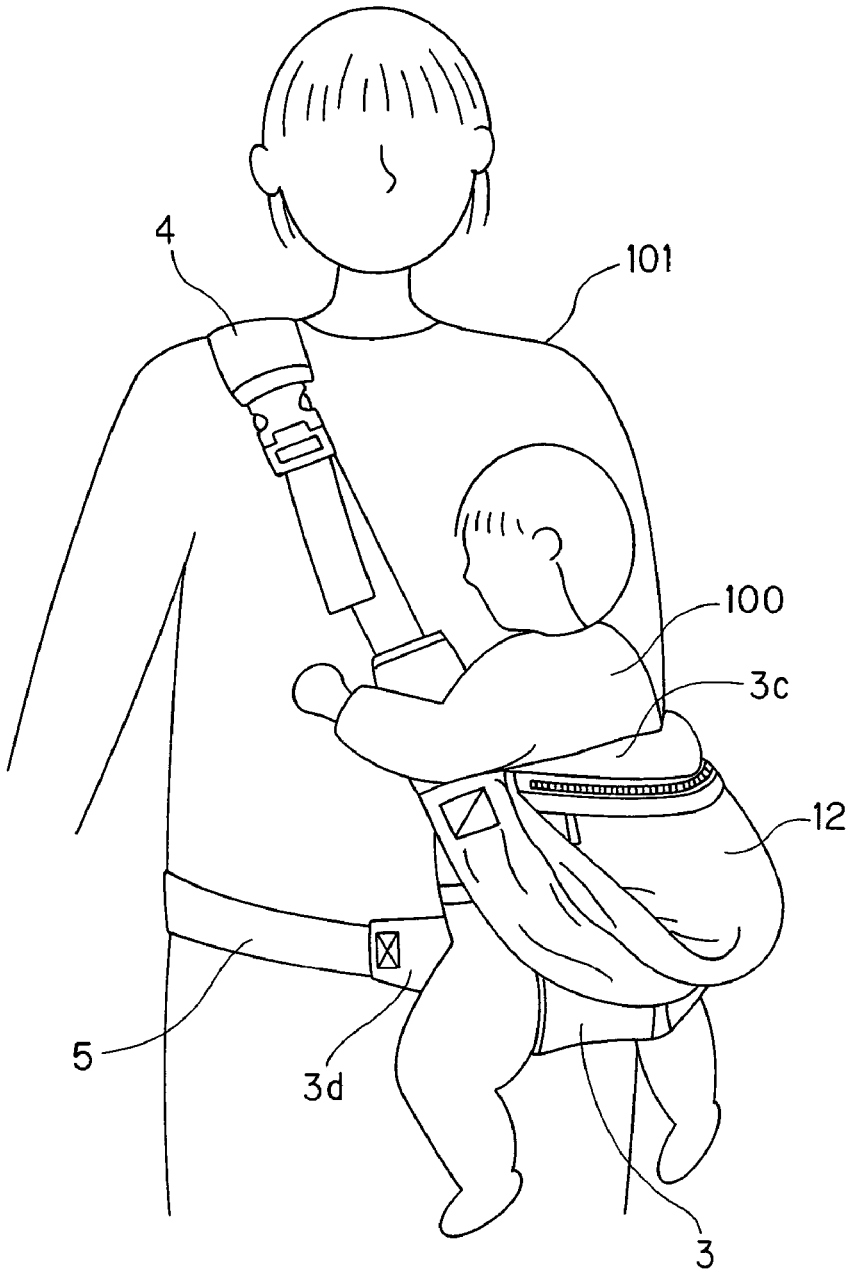
FIG. 4 is a perspective view showing usage condition of the infant carrier.

FIG. 4 shows a condition in which an infant 100 is supported with the infant carrier 1 such that it faces a user 101. To realize such supporting, the infant carrier 1 is mounted on the user 101 in a following procedure. First, the support portion 3 is inverted upside down and with its outside face 3*a* facing the user 101, the joint belts 6 and 7 of the waist belt 5 are wound around the waist of the user 101 and the buckles 8 and 9 are engaged to position the support portion 3 on the front face of the user 101. After that, the user 101 holds the infant 100 such that it faces him or her and then, the support portion 3 is wound around the back of the infant 100 from the hip and its top end is folded back. Then, the shoulder belt portion 4 is hooked around the shoulder of the user obliquely with respect to the user front body. As a consequence, the support portion 3 forms a bag shaped or belt shaped portion on the front face of the user 101 so that the infant 100 can be accommodated on the side of the inside face 3*b* of the support portion 3 and supported. By winding an auxiliary belt 50 (see FIGS. 2 and 3) provided on the support portion 3 around the body of the infant 100 and by engaging the buckles 51 and 52, the infant 100 can be captured stably to the support portion 3.

As shown in FIGS. 1 to 4, a bag portion 10 is provided at the top end portion 3*c* of the support portion 3. As evident from FIG. 5, the bag portion 10 comprises a first accommodating bag 11 for accommodating the support portion 3 and a second accommodating bag (accommodating portion) 12 for accommodating a hood relating to the present invention. These accommodating bags 11 and 12 have bag main bodies 13 and 14. These bag main bodies 13 and 14 are sewed, or joined to an intermediate portion of the upper sheet 3A of the support portion 3 along the sewing line P2 and jointed to end portions, front and rear of the upper sheet 3A through fasteners 15 and 16. As a consequence, the accommodating bags 11 and 12 are constructed as a bag which can be opened and closed using the upper sheet 3A as a lid material.

Figure 6:
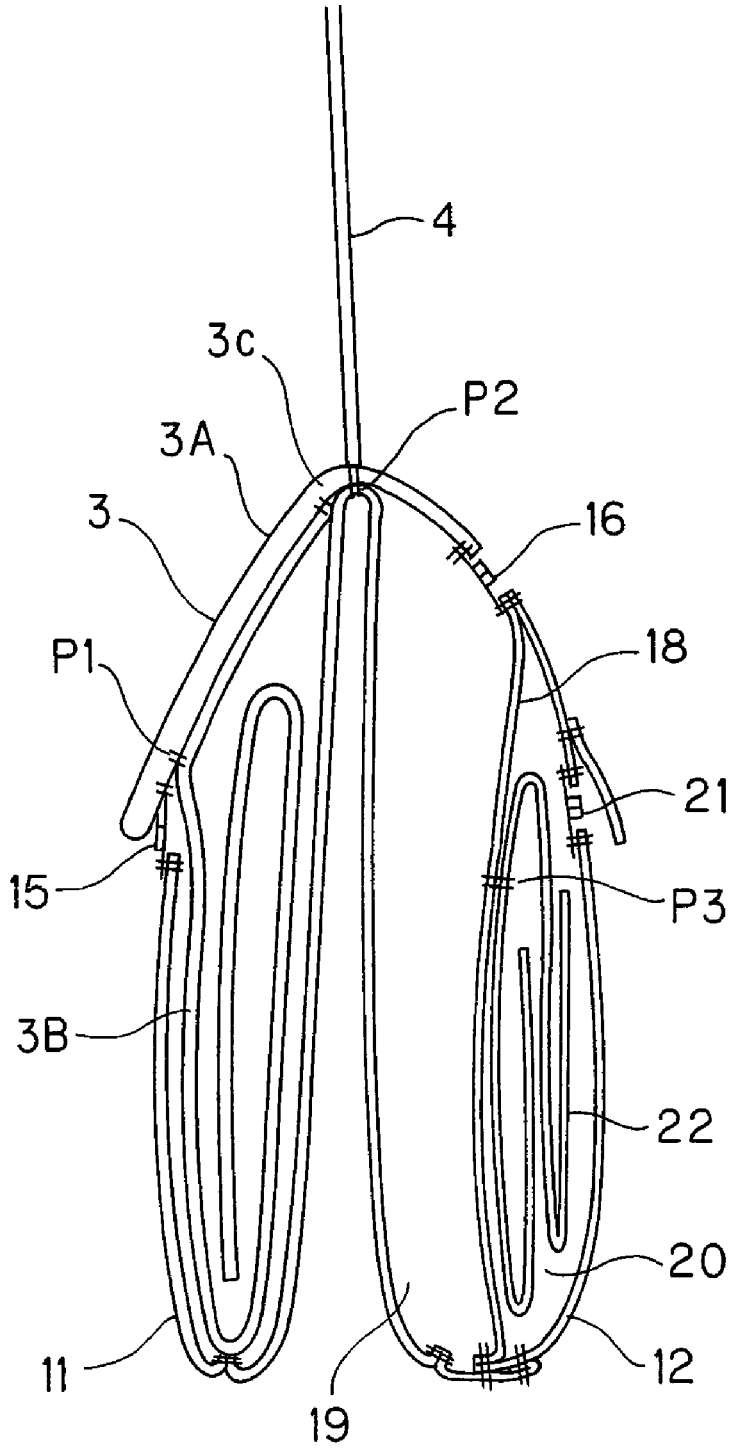
FIG. 6 is a sectional view showing a condition in which the bottom sheet of the support portion is accommodated in a first accommodating bag.
Figure 7:
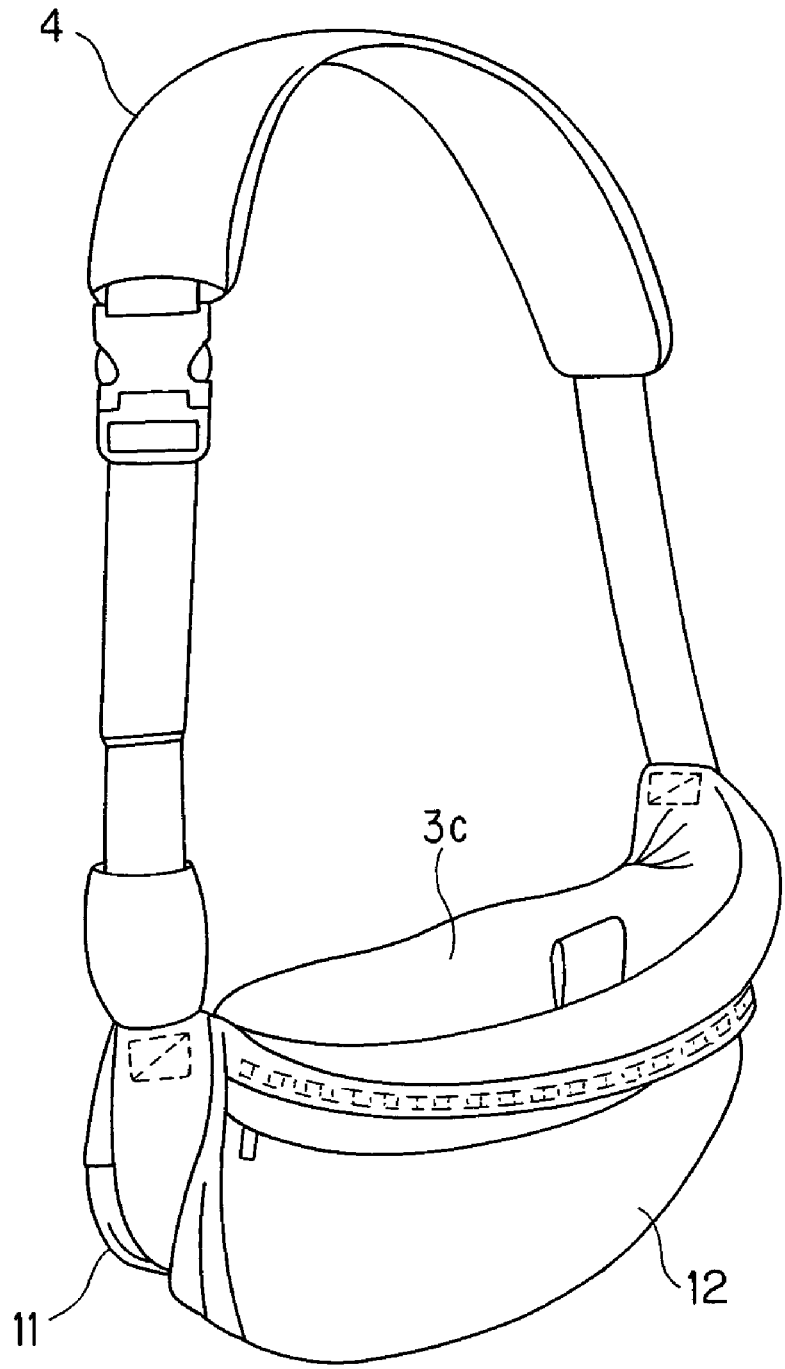
FIG. 7 is a perspective view of the infant carrier corresponding to the condition of FIG. 6.

The lower sheet 3B of the support portion 3 is inserted into the inside of the first accommodating bag 11 through an opening portion thereof and sewed to the upper sheet 3A along the sewing line P1 (see FIG. 3). Therefore, as shown in FIG. 6, the lower sheet 3B can be folded and accommodated into the inside of the first accommodating bag 11 by opening the fastener 15. Consequently, as shown in FIG. 7, the infant carrier 1 can be reformed into just like a shoulder bag to achieve convenience for carrying.

Figure 5:
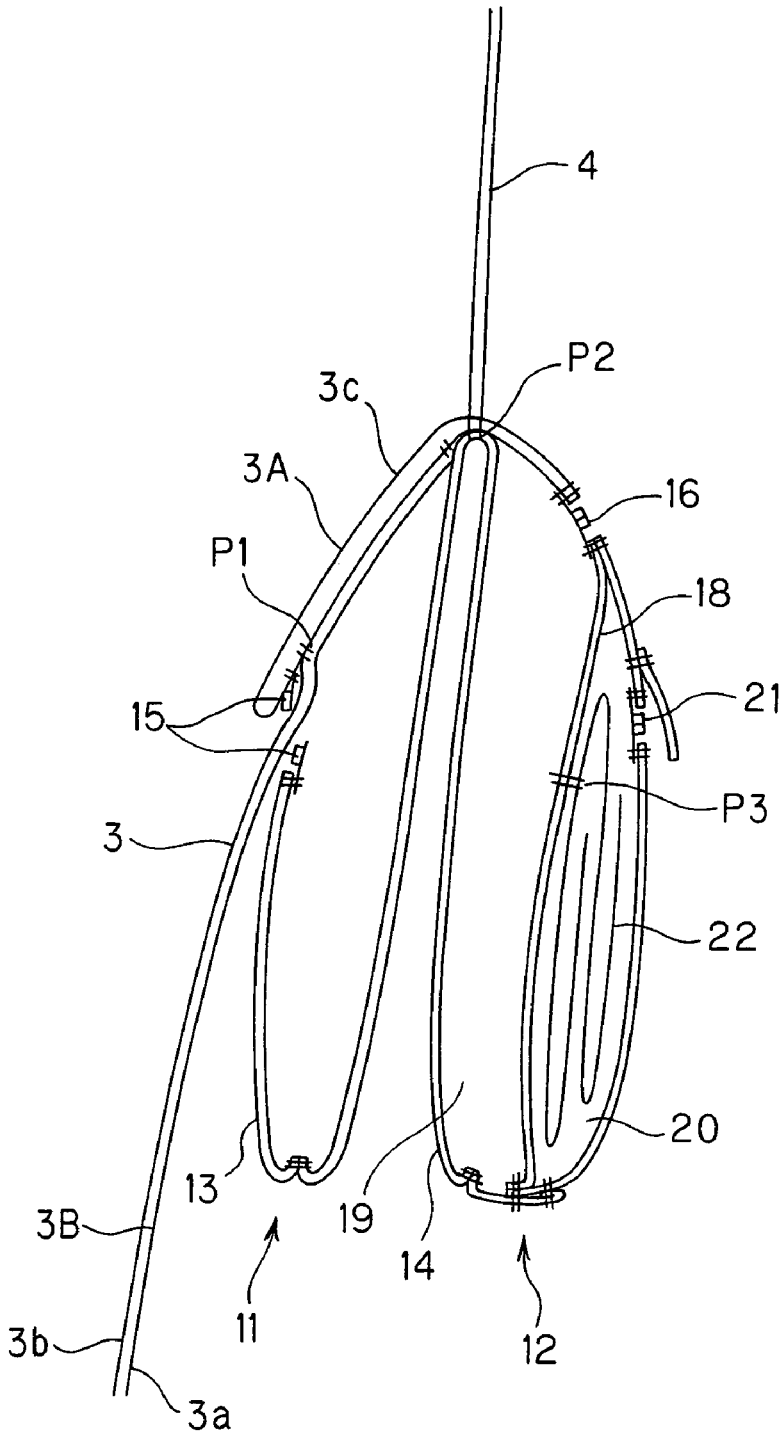
FIG. 5 is a sectional view of a bag portion provided at the top end of a support portion.

As shown in FIGS. 5 and 6, the bag main body 14 of the second accommodating bag 12 on the front side (right side in FIGS. 5 and 6) is provided with a partition sheet 18 which deflects to the forward with respect to the fastener 16, thereby dividing the inside of the second accommodating bag 12 into a first accommodating chamber 19 and a second accommodating chamber 20. The bag main body 14 is provided with an opening portion for the second accommodating chamber 20 and along the opening portion is provided a fastener 21. The first accommodating chamber 19 is used as an article bag. On the other hand, the hood 22 relating to the present invention is accommodated in the second accommodating chamber 20 in a folded condition.

Figure 8:
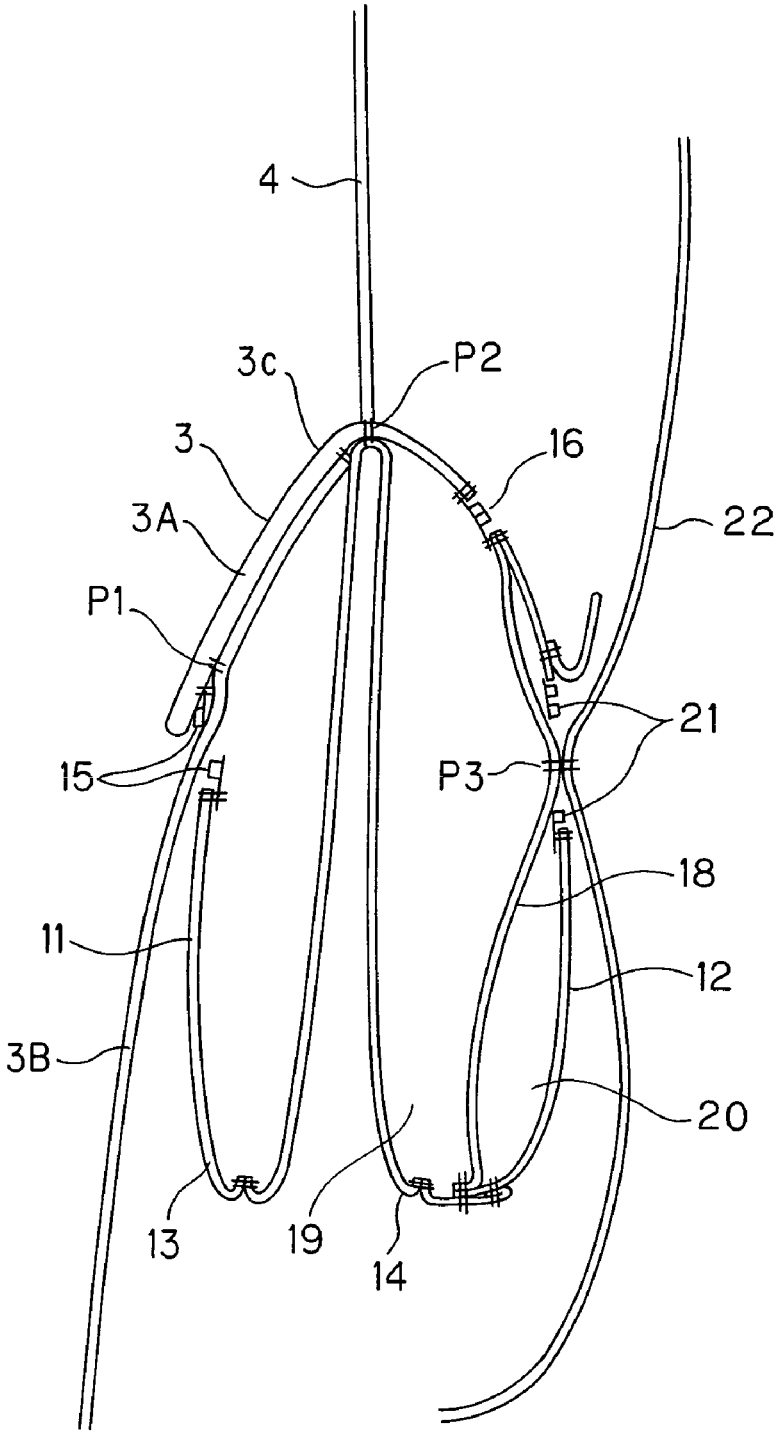
FIG. 8 is a perspective view showing a condition in which the hood is developed from a second accommodating bag.
Figure 9:
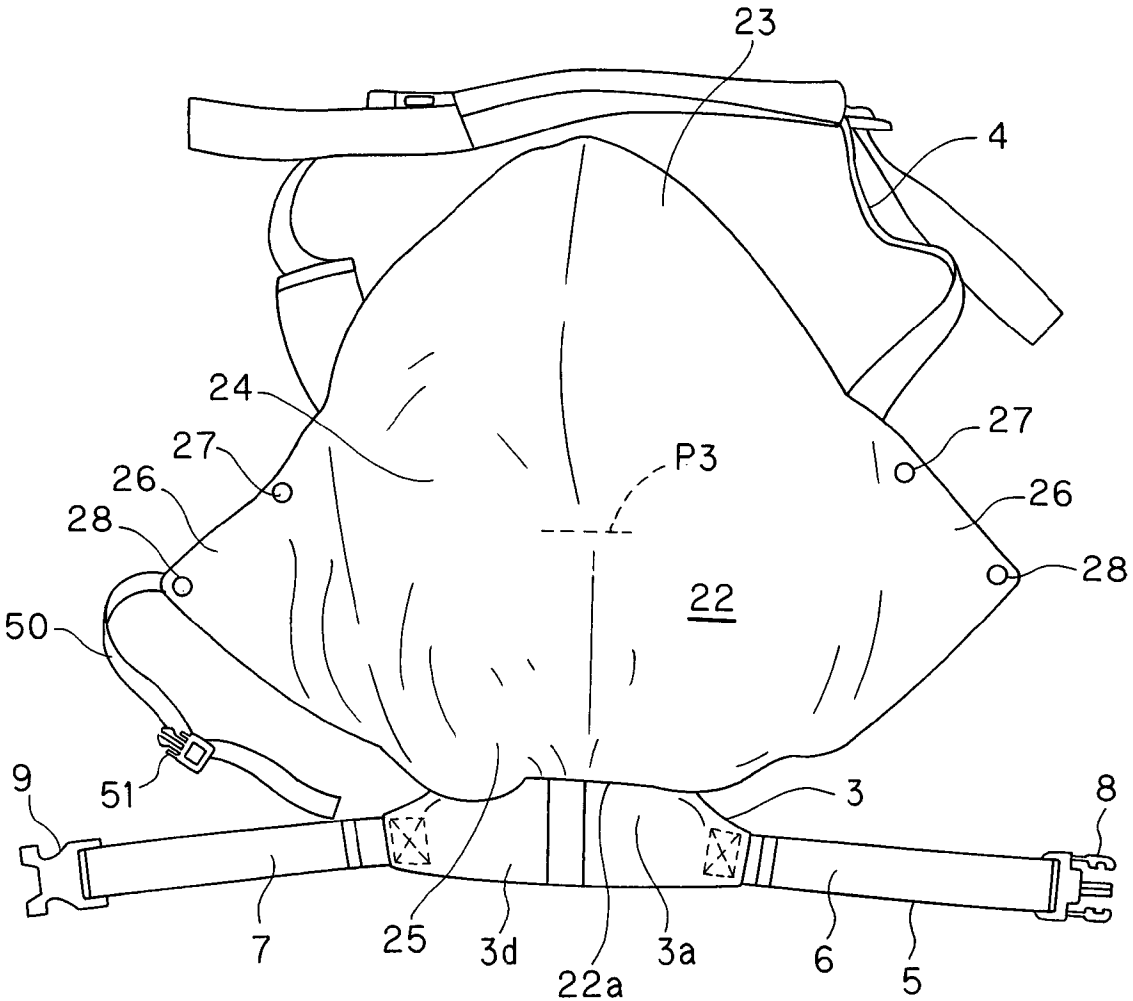
FIG. 9 is a view showing the infant carrier with its hood developed as seen from the outside face of the support portion.
Figure 10:
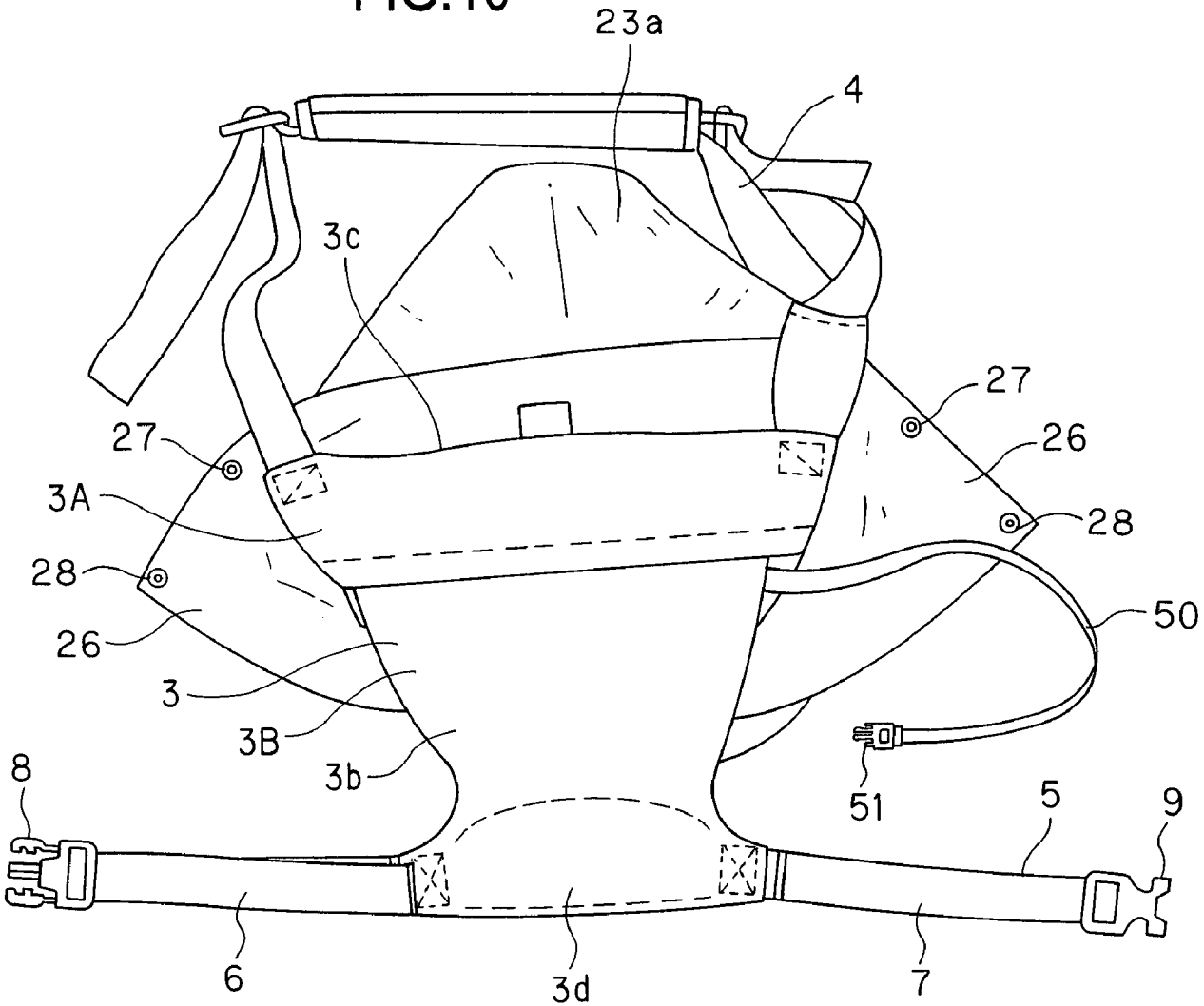
FIG. 10 is a view showing the infant carrier with its hood developed as seen from the inside face of the support portion.

The hood 22 is sewed to the partition sheet 18 along a sewing line P3 (see FIG. 9). By opening the fastener 21 as shown in FIG. 8, the hood 22 can be pulled out from the second accommodating chamber 20 and developed in front of the infant carrier 1. FIG. 9 shows a condition in which the hood 22 is developed from the front side of the infant carrier 1 and FIG. 10 shows the infant carrier 1 in the same condition from an opposite side.

As shown in FIG. 9, the hood 22 comprises a head protecting portion 23 for covering the head of an infant, a back protecting portion (intermediate portion) 24 for covering the back of the infant, a hip protecting portion 25 for covering the hip of the infant and joint portions 26 which project sideways substantially in the form of a triangle. The sewing line P3 along which the hood 22 and the partition sheet 18 of the second accommodating bag 12 are joined to each other is set on the back protecting portion 24. The head protecting portion 23 is provided with a bag portion 23*a* for covering the head of the infant 100 (see FIG. 10). A rubber band (not shown) is contained at the bottom end portion 22*a* of the hood 22, so that an appropriate tensile force due to elastic restoration force of the rubber band acts on the bottom end portion 22*a* toward the center in the right and left direction.

Figure 11:
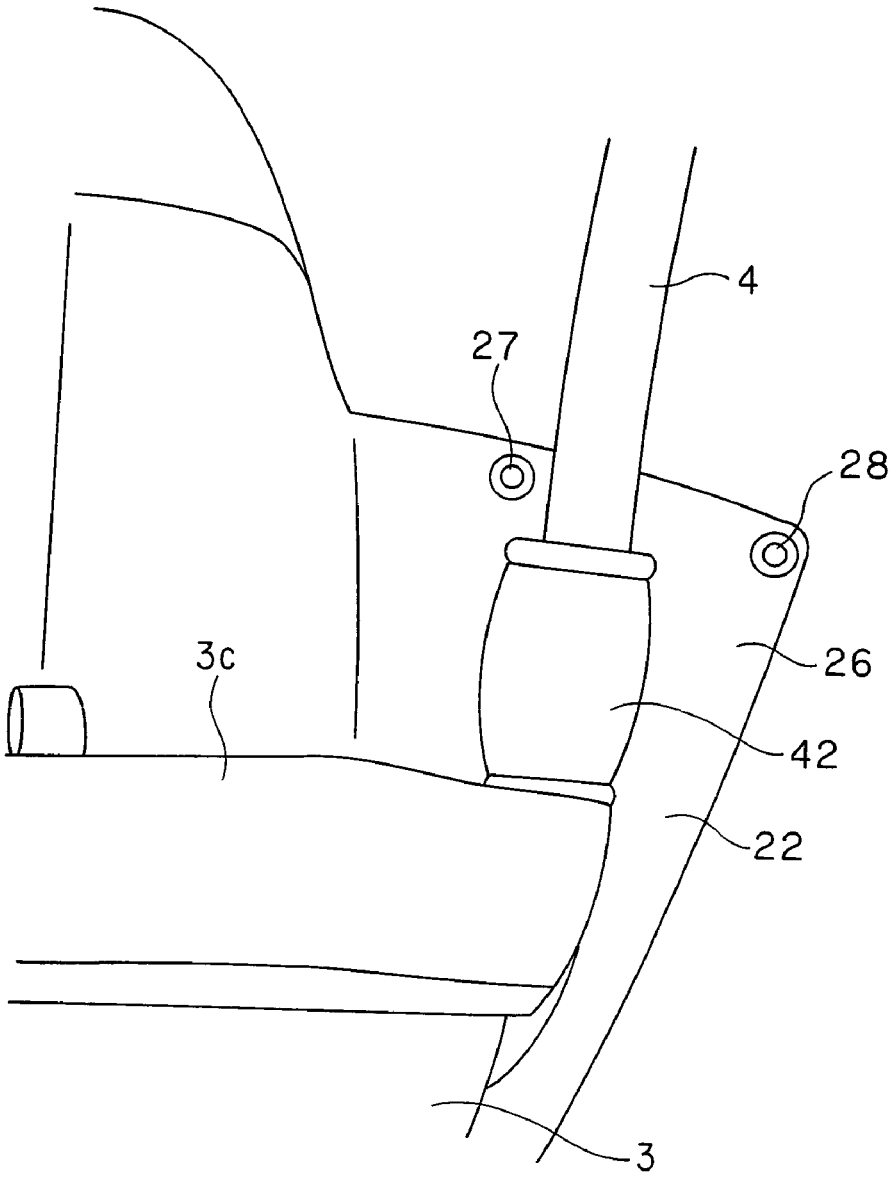
FIG. 11 is a view showing a joint portion at an end of the hood and a shoulder belt portion.

As also shown in FIG. 11, each of the joint portions 26 is provided with a pair of hooks 27 and 28 which can engage with each other. By winding each joint portion 26 around the shoulder belt portion 4 and engaging the hooks 27 and 28 together, both sides of the hood 22 are connected to the shoulder belt portion 4 so as to prevent the hood 22 from being turned up. As a consequence, the joint portions 26 and the hooks 27 and 28 compose joint means of the present invention.

Figure 12:
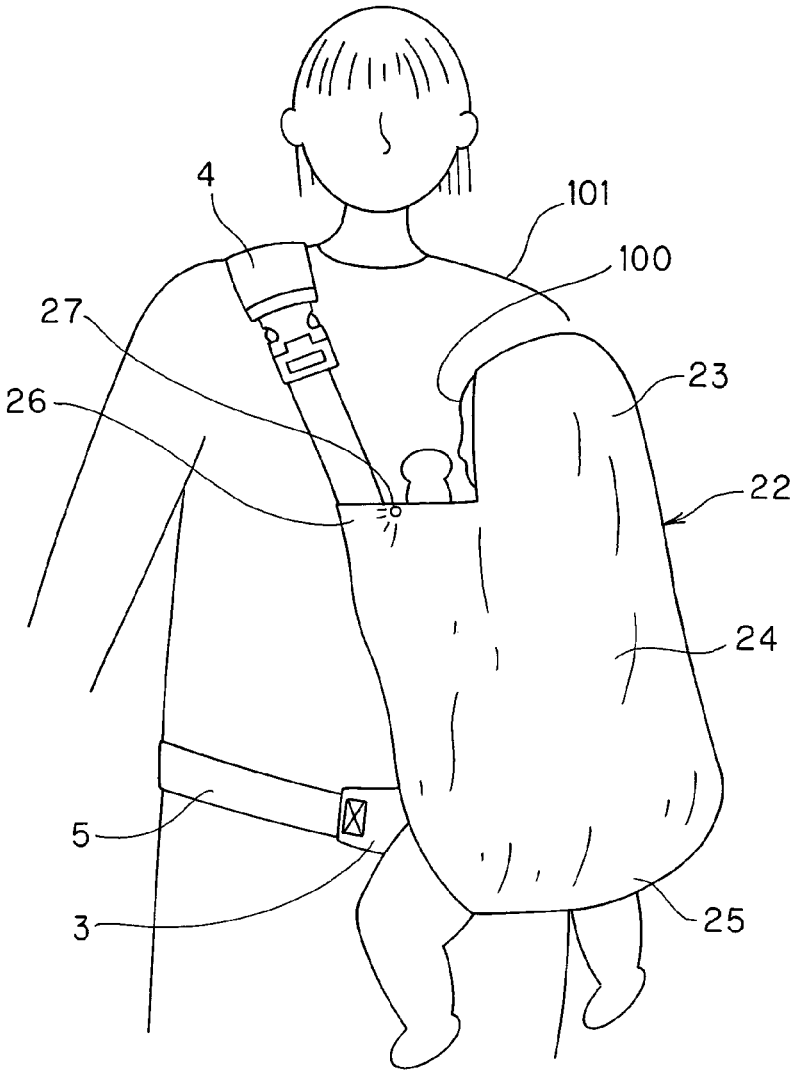
FIG. 12 is a perspective view showing a condition in which an infant is covered with the hood.

FIG. 12 shows a condition in which the hood 22 is pulled out from the second accommodating bag 12 and developed so as to cover the infant 100. Both sides of the hood 22 are connected to the shoulder belt portion 4 using the joint portions 26 and the hooks 27 and 28. The bottom end portion 22*a* of the hood 22 is caught by the hip of the infant 100 using the tensile force of the rubber band. As described above, according to the infant carrier 1 of this embodiment, the infant 100 supported by the support portion 3 is covered from the head to the hip by the hood 22 so as to protect the infant 100 from wind and rain. Therefore, by using the hood 22 appropriately corresponding to the weather, the body temperature of the infant can be adjusted easily. Because the hood 22 can be accommodated in the second accommodating chamber 20 of the second accommodating bag 12 when the hood 22 is not used, the hood 22 is not a hindrance, thereby securing convenience for carrying.

Next, the detail of the shoulder belt portion 4 will be described. As shown in FIG. 1, the shoulder belt portion 4 comprises a shoulder hooking belt 31 and right and left joint belts 32 and 33 for connecting the shoulder hooking belt 31 with the support portion 3. An end portion of the joint belt 32 on the left side (right side in FIGS. 1 and 2) is joined to an end portion 31*a* of the shoulder hooking portion 31*a* via a ladder 34. The ladder 34 is fixed to the end portion 31*a* of the shoulder hooking belt 31 and the end side of the joint belt 32 is connected to the ladder 34 such that the length of the joint belt 32 can be adjusted. That is, the joint position of the joint belt 31 to the ladder 34 can be adjusted in the length direction of the joint belt 31 and by changing the joint position, the length of the joint belt 31 from the fixing position on the support portion 3 to the ladder 34 can be adjusted. When the infant carrier 1 is used, the ladder 34 can be concealed inside a cylindrical shoulder belt pad 35 mounted outside the shoulder hooking belt 31.

Figure 13:
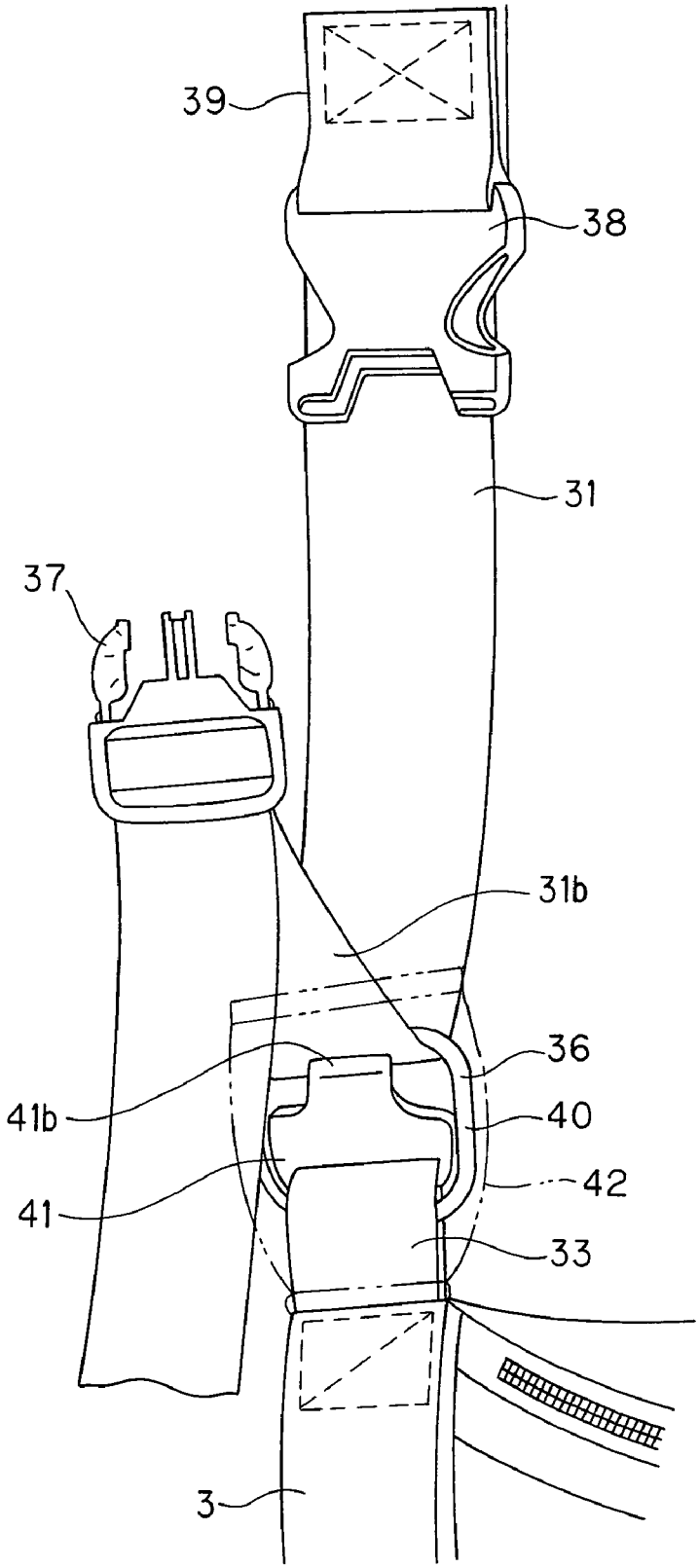
FIG. 13 is an enlargement view of the joint portion between the shoulder belt portion and the support portion.

As shown in FIG. 13 in detail, the joint belt 33 on the right side (the left side in FIGS. 1 and 2) is shorter than the joint belt 32 on an opposite side and a D-ring 36 is attached to a front end thereof. A male buckle 37 is attached to the end portion 31*b* of the shoulder hooking belt 31 and a female buckle 38 to be engaged with the male buckle 37 is attached on the side of the center in the length direction of the shoulder hooking belt 31 with respect to the male buckle 37 via the joint belt 39. The attaching position of the male buckle 37 to the shoulder hooking belt 31 can be adjusted in the length direction of the shoulder hooking belt 31.

Figure 14:
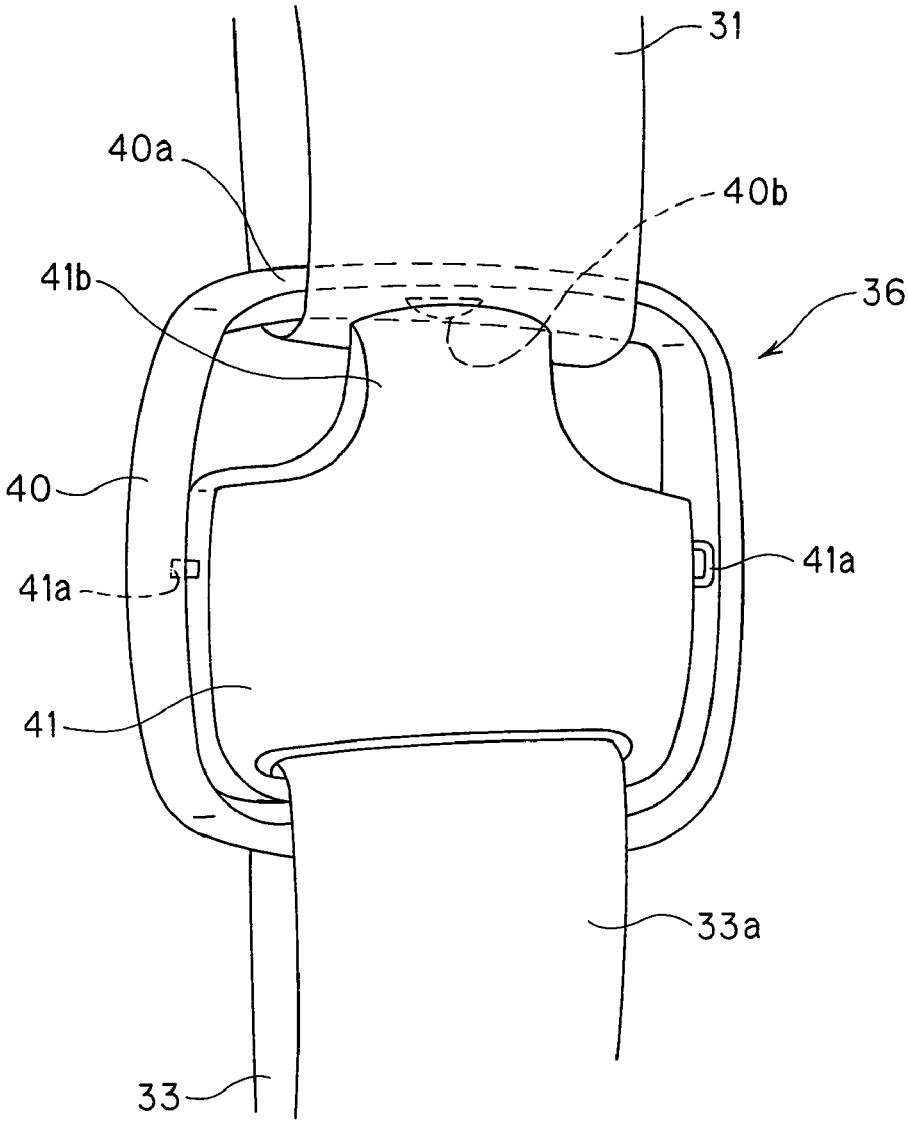
FIG. 14 is an enlarged view showing a D ring connecting the shoulder belt and the support portion and its vicinity.

As shown in FIG. 14 in detail, the D-ring 36 comprises a ring main body 40 having a D ring shape and a flap 41 as a slippage preventing member attached rotatably around a shaft 41*a* within the inside periphery of the ring main body 40. The flap 41 is attached to a loop portion 33*a* at the front end of the joint belt 33 together with the ring main body 40 and a tongue 41*b* at its front end extends to a position where it engages with a protrusion 40*b* as a stopper provided on the inside periphery of a bridge 40*a* at the front end of the joint belt 33 together with the ring main body 40. Thus, a rotation range of the flap 41 around the shaft 41*a* is limited by an engagement between the tongue 41*b* and the protrusion 40*b*. That is, the tongue 41*b* can rotate only on one side of the ring main body 40 and cannot move to an opposite side of the ring main body 40 through the bridge 40*a*.

Returning to FIG. 13, the shoulder hooking belt 31 is passed though the D-ring 36 by passing the male buckle 37 provided at the end portion 31*b* through the ring main body 40 from a rear side of FIG. 13 or an opposite side to a side in which the tongue 41*b* of the flap 41 is provided. Then, by engaging the male buckle 37 with the female buckle 38, the shoulder hooking belt 31 and the joint belt 33 are joined to each other through the D-ring 36. According to such a joint mechanism, even if the male buckle 31 disengages from the female buckle 38, the male buckle 37 is caught by the tongue 41 so that it cannot pass through the ring main body 40 of the D-ring 36. The user 101 needs to operate the tongue 41*b* of the flap 41 in a direction of leaving the ring main body 40 so as to generate a gap between the tongue 41*b* and the ring main body 40 and introduce the male buckle 37 so that it can pass through that gap. Therefore, there is no fear that the shoulder hooking belt 31 may disengage from the joint belt 33 completely until the user 101 operates in such a way intentionally and as a result, the safety of the shoulder belt portion 4 is increased. In the meantime, the joint belt 33 and the D-ring 36 can be concealed completely by a cylindrical cover 42 sewed onto the support portion 3.

The present invention is not limited to the above-described embodiment, but may be carried out in various embodiments. For example, although according to the above-mentioned embodiment, the hood 22 is fixed by sewing onto the partition sheet 18, the hood 22 may be fixed to the accommodating bag 12 with other means. The hood 22 may be formed detachably relative to the accommodating bag 12. The material of the hood 22 may be selected appropriately. For example, it is permissible to use various kinds of cloths or resin sheets as the hood 22. The surface of the hood 22 may be water-repellent treated. The shape and size of the hood 22 are not limited to this embodiment but it is permissible to select an appropriate shape and size depending on the application of the hood.

The configuration of the belt portion is not limited to the above-described embodiment but the present invention can be applied to, for example, an infant carrier of a type whose support portion is mounted on the user using two shoulder hooking belts. The configuration of the support portion is not limited to the above-described embodiment. The present invention can be applied to not only a configuration in which the belt portion and the support portion are sewed together but also such an infant carrier in which all or part of the support portion is constructed as an attachment attachable to and detachable from the belt portion. Anyway, as the support portion, various kinds thereof can be selected as long as it has a function for supporting an infant in conditions in which it is connected to the belt portion. The accommodating portion for accommodating the hood is not limited to the above-described configuration but may be provided at an appropriate position on the outside face (face opposite to a face which makes contact with an infant) of the support portion. The joint means is not limited to one using the side portion of the hood and hooks but may utilize various kinds of joint means such as a belt, surface fastener, buckle.

What is claimed is:

1. An infant carrier with hood comprising:

a belt portion to be mounted on a user; and a support portion connected to the belt portion for supporting an infant, wherein the support portion comprises an upper sheet and a lower sheet, wherein the belt portion comprises a shoulder belt portion joined to the upper sheet of the support portion, wherein a bag-like accommodating portion is provided on an outside face of the support portion, said bag-like accommodating portion comprises bag main bodies joined to the upper sheet so as to form first and second accommodating bags which are each opened and closed using the upper sheet as a lid, the second accommodating bag serves as the accommodating portion, wherein the lower sheet is adapted to be accommodated in the first accommodating bag, wherein a hood capable of being developed so as to cover the infant supported by the support portion is adapted to be accommodated in the second accommodating bag, and wherein the infant carrier is transformed to a shoulder bag when the lower sheet is accommodated in the first accommodating bag and the hood is accommodated in the second accommodating bag.

2. The infant carrier with hood according to claim 1, wherein the hood comprises a head protecting portion for covering the head of the infant and a hip protecting portion for covering the hip of the infant and is connected to the support portion at an intermediate portion sandwiched between the head protecting portion and the hip protecting portion.

3. The infant carrier with hood according to claim 1, further comprising joint means for jointing both side portions of the hood and the belt portion with each other.

4. The infant carrier with hood according to claim 1, wherein an inside of the second accommodating bag is partitioned into two or more accommodating chambers and the hood is adapted to be accommodated in any one of the accommodating chambers.

5. The infant carrier with hood according to claim 1, wherein a waist belt portion is joined to the lower sheet of the support portion.

6. The infant carrier with hood according to claim 1, wherein both ends of the shoulder belt portion are joined to the upper sheet of the support portion between the first accommodating bag and the second accommodating bag, and thus the two accommodating bags are hung from both sides of the upper sheet of the support portion.

* * * * *

UNITED STATES PATENT AND TRADEMARK OFFICE

CERTIFICATE OF CORRECTION

PATENT NO. : 7,661,566 B2
APPLICATION NO. : 11/209641
DATED : February 16, 2010
INVENTOR(S) : Yoshie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1211 days.

Signed and Sealed this

Twenty-eighth Day of December, 2010

David J. Kappos

David J. Kappos
*Director of the United States Patent and Trademark Office*